US009723420B2

(12) United States Patent
Family et al.

(10) Patent No.: US 9,723,420 B2
(45) Date of Patent: Aug. 1, 2017

(54) SYSTEM AND METHOD FOR ROBUST SIMULTANEOUS DRIVER MEASUREMENT FOR A SPEAKER SYSTEM

(71) Applicant: Apple Inc., Cupertino, CA (US)

(72) Inventors: Afrooz Family, Emerald Hills, CA (US); Tom-Davy Saux, Santa Clara, CA (US); Martin E. Johnson, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/771,480

(22) PCT Filed: Mar. 5, 2014

(86) PCT No.: PCT/US2014/020904
§ 371 (c)(1),
(2) Date: Aug. 28, 2015

(87) PCT Pub. No.: WO2014/138300
PCT Pub. Date: Sep. 12, 2014

(65) Prior Publication Data

US 2015/0382121 A1 Dec. 31, 2015

Related U.S. Application Data

(60) Provisional application No. 61/773,354, filed on Mar. 6, 2013.

(51) Int. Cl.
*H04R 29/00* (2006.01)
*H04R 27/00* (2006.01)

(52) U.S. Cl.
CPC ..... *H04R 29/002* (2013.01); *H04R 29/001* (2013.01); *H04R 27/00* (2013.01); *H04R 2420/05* (2013.01)

(58) Field of Classification Search
None
See application file for complete search history.

(56) References Cited

U.S. PATENT DOCUMENTS 4,908,868 A 3/1990 McTaggart
7,726,190 B2 6/2010 Matsumoto et al.
(Continued)

FOREIGN PATENT DOCUMENTS

EP 2375779 A2 10/2011

OTHER PUBLICATIONS

PCT International Preliminary Report on Patentability for PCT International Appln No. PCT/US2014/020904 mailed on Sep. 17, 2015 (8 pages).
(Continued)

*Primary Examiner* — Paul Huber
(74) *Attorney, Agent, or Firm* — Blakely, Sokoloff, Taylor & Zafman LLP

(57) ABSTRACT

A system and method for measuring the performance of a plurality of transducers integrated in one or more loudspeakers is described. The method simultaneously drives each transducer to emit sounds corresponding to distinct orthogonal test signals. A listening device senses sounds produced by the orthogonal test signals and analyzes the sensed audio signal to determine the performance of each transducer. By using orthogonal test signals, the multiple transducers may be measured and/or characterized simultaneously and with limited affect from extraneous noises.

30 Claims, 10 Drawing Sheets

(56) References Cited

U.S. PATENT DOCUMENTS

| | | | | |
|---|---|---|---|---|
| 7,881,485 | B2 | 2/2011 | Sporer et al. | |
| 2005/0190929 | A1* | 9/2005 | Sporer | H04R 3/02 381/93 |
| 2005/0207592 | A1* | 9/2005 | Sporer | H04S 7/30 381/94.2 |
| 2006/0251265 | A1 | 11/2006 | Asada | |
| 2008/0144864 | A1 | 6/2008 | Huon | |
| 2008/0175394 | A1 | 7/2008 | Goodwin | |

OTHER PUBLICATIONS

PCT International Search Report and Written Opinion for PCT International Appln No. PCT/US2014/020904 filed on Mar. 5, 2014 (11 pages).

Griffiths, Dennis. "Correlation of Pseudo Random Noice to Measure Time Delay as a Function of Frequency," 107th Convention, Audio Engineering Society, New York, Sep. 24-27, 1999, 12 pages.

"Orthogonal Functions," May 9, 2003 (5 pages), retrieved from the Internet at: http://www.math.umd.edu/~psg/401/ortho.pdf.

* cited by examiner

SYSTEM AND METHOD FOR ROBUST SIMULTANEOUS DRIVER MEASUREMENT FOR A SPEAKER SYSTEM

RELATED MATTERS

This application is a U.S. National Phase Application under 35 U.S.C. §371 of International Application No. PCT/US2014/020904, filed Mar. 5, 2014, which claims the benefit of the earlier filing date of U.S. provisional application No. 61/773,354, filed Mar. 6, 2013, and this application hereby incorporates herein by reference these previous patent applications.

FIELD

A system and method for measuring and characterizing sound output by a loudspeaker or loudspeaker system using highly orthogonal test signals is described. Other embodiments are also described.

BACKGROUND

Loudspeakers and loudspeaker systems with multiple transducers (hereinafter "loudspeakers") allow for the reproduction of sound in a listening environment or area. Each transducer may be individually driven such that the loudspeakers may emit complex sound patterns into the listening area. Due to the complexity of these sound patterns, each transducer in the loudspeakers must be operating within a set of known parameters or tolerances. Accordingly, each transducer must be measured and characterized to ensure conformance with expected standards. In the event that a transducer is operating below expectations, resulting sounds may be inaccurate and distorted.

SUMMARY

An embodiment of the invention relates to a method for measuring the performance of a plurality of transducers integrated in one or more loudspeakers. In one embodiment, the method simultaneously drives each transducer to emit sounds corresponding to distinct orthogonal test signals. A listening device senses sounds produced by the orthogonal test signals and analyzes the sensed audio signal to determine the performance of each transducer.

In one embodiment, the sensed audio signal is summed with each orthogonal test signal to produce a set of cross-correlation signals. The cross-correlation signals are compared with parameters and/or tolerances to determine the performance of each transducer.

In a factory scenario, the method describe above allows for measurement and characterization of a multi-transducer loudspeaker system in a greatly reduced period of time in comparison to other test systems. For example, the method allows for the simultaneous testing of multiple transducers through the use of the orthogonal test signals. The method immediately reveals if any transducer is disconnected, has inverted polarity, or otherwise performing poorly. Upon detection of an error, the corresponding transducers may be replaced or repaired before other factory testing is performed. Finding performance errors quickly saves valuable factory time and resources compared to sequential transducer testing.

In a home entertainment scenario, this method may be used to calibrate a loudspeaker. By using orthogonal test signals, measurement and calibration of the loudspeaker is more impervious to extraneous sounds. For example, a user/listener may calibrate a loudspeaker while carrying on a conversation or playing an audio track without affecting the calibration process.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1A:
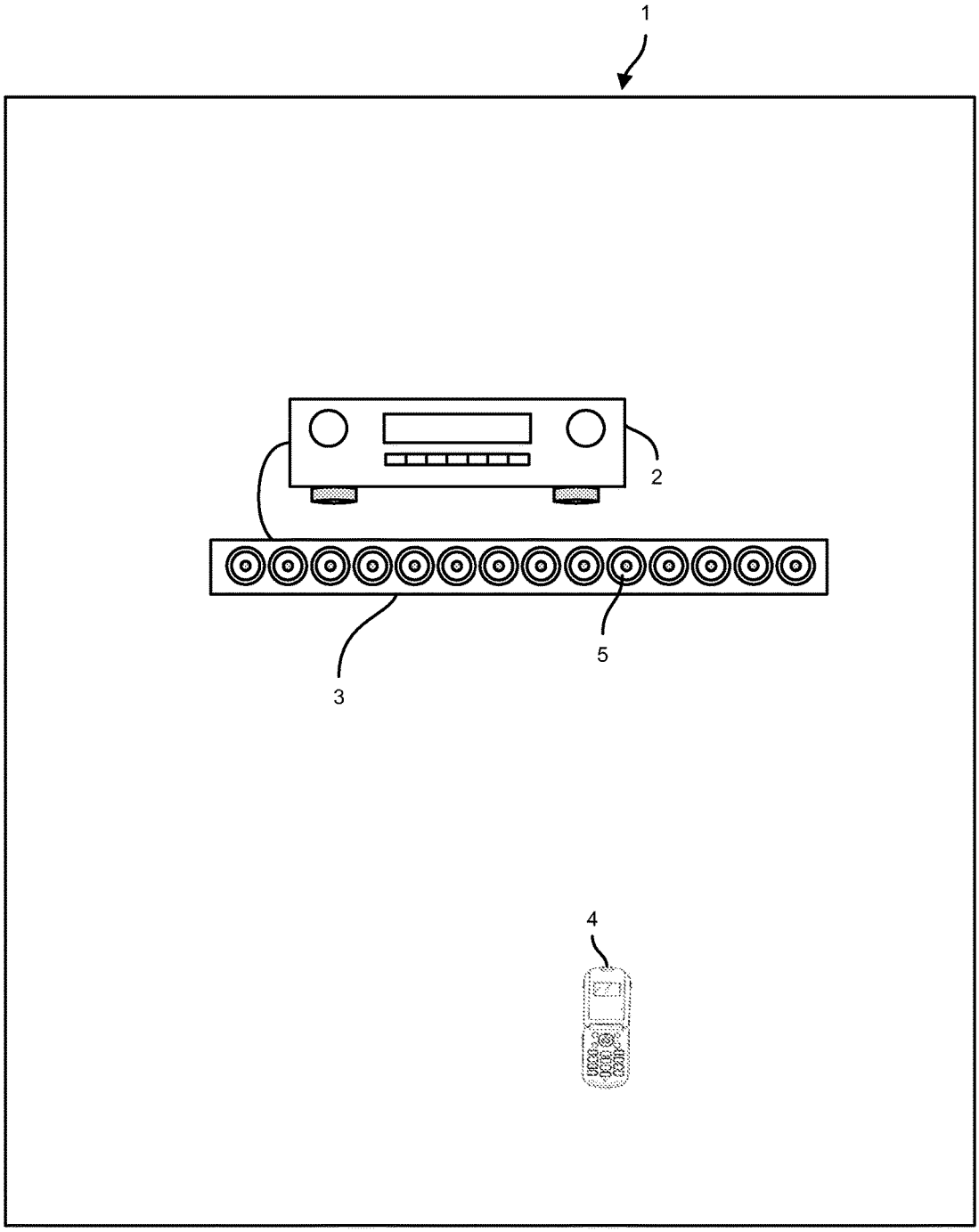
FIG. 1A shows a view of a listening area with a test receiver, a single loudspeaker, and a listening device according to one embodiment.

FIG. 1A shows a view of a listening area 1 with a test receiver 2, a loudspeaker 3, and a listening device 4. The test receiver 2 may be coupled to the loudspeaker 3 to drive individual transducers 5 in the loudspeaker 3 to emit various sounds and sound patterns into the listening area 1. The listening device 4 may sense these sounds produced by the test receiver 2 and the loudspeaker 3 using one or more microphones as will be described in further detail below.

The loudspeaker 3 includes a set of transducers 5 arranged in rows, columns, and/or any other configuration. The transducers 5 may be any combination of full-range drivers, mid-range drivers, subwoofers, woofers, and tweeters. Each of the transducers 5 may use a lightweight diaphragm, or cone, connected to a rigid basket, or frame, via a flexible suspension that constrains a coil of wire (e.g., a voice coil) to move axially through a cylindrical magnetic gap. When an electrical audio signal is applied to the voice coil, a magnetic field is created by the electric current in the voice coil, making it a variable electromagnet. The coil and the transducers' 5 magnetic system interact, generating a mechanical force that causes the coil (and thus, the attached cone) to move back and forth, thereby reproducing sound under the control of the applied electrical audio signal coming from an audio source, such as the test receiver 2. Although electromagnetic dynamic loudspeaker drivers are described, those skilled in the art will recognize that other types of loudspeaker drivers, such as planar electromagnetic and electrostatic drivers may be used for the transducers 5.

Figure 1B:
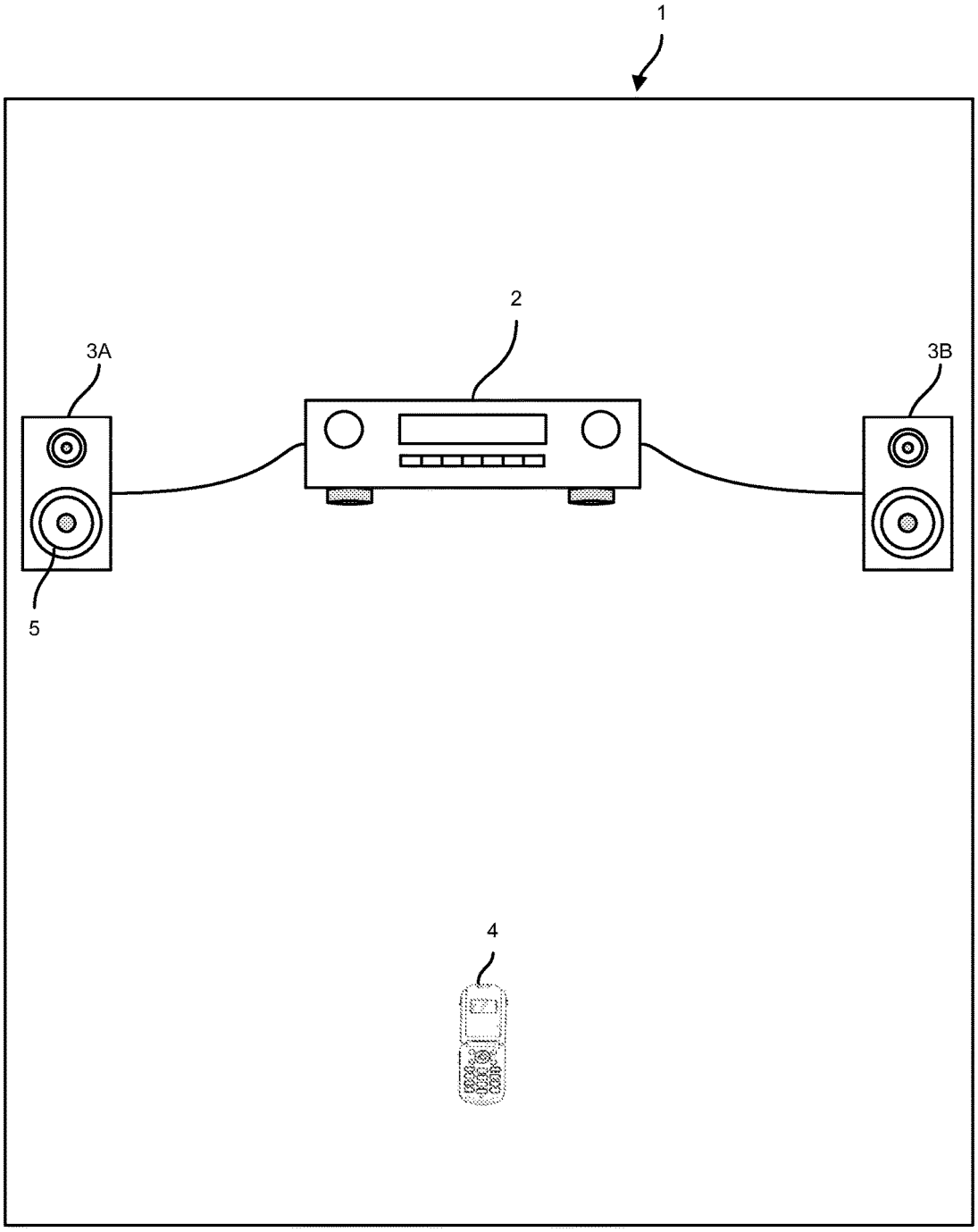
FIG. 1B shows a view of a listening area with a test receiver, multiple loudspeakers, and a listening device according to one embodiment.

Although shown in FIG. 1A as a loudspeaker array with multiple transducers 5 (e.g., a multi-way loudspeaker), in other embodiments the loudspeaker 3 may be a traditional speaker unit with a single transducer 5. For example, the loudspeaker 3 may include a single tweeter, a single mid-range driver, and/or a single full-range driver. In another embodiment, as shown in FIG. 1B, multiple loudspeakers 3A and 3B may be coupled to the test receiver 2. The multiple loudspeakers 3A and 3B may have one or more transducers 5 as described above. The loudspeakers 3A and 3B may be positioned in the listening area 1 to respectively represent front left and front right channels of a piece of sound program content (e.g., a musical composition or an audio track for a movie).

Although described in relation to dedicated speakers, the loudspeaker 3 may be any device that houses transducers 5. For example, the loudspeaker 3 may be defined by a laptop computer, a mobile audio device, or a tablet computer with integrated transducers 5 for emitting sound.

Each transducer 5 may be individually and separately driven to produce sound in response to separate and discrete audio signals received from an audio source (e.g., the test receiver 2). By allowing the transducers 5 in the loudspeaker 3 to be individually and separately driven according to different parameters and settings (including delays and energy levels), the loudspeaker 3 may produce numerous beam patterns and/or general sounds that accurately represent each channel of a piece of sound program content output by the test receiver 2.

As shown in FIGS. 1A and 1B, the loudspeakers 3 are coupled to the test receiver 2 through the use of wires or conduit. For example, each of the loudspeakers 3 may include two wiring points and the test receiver 2 may include complementary wiring points. The wiring points may be binding posts or spring clips on the back of the loudspeakers 3 and the test receiver 2, respectively. Wires are separately wrapped around or are otherwise coupled to respective wiring points to electrically couple the loudspeakers 3 to the test receiver 2.

In other embodiments, the loudspeakers 3 are coupled to the test receiver 2 using wireless protocols such that the loudspeakers 3 and the test receiver 2 are not physically joined but maintain a radio-frequency connection. For example, the loudspeakers 3 may include WiFi or Bluetooth receivers for receiving audio signals from a corresponding WiFi and/or Bluetooth transmitter in the test receiver 2. In some embodiments, the loudspeakers 3 may include integrated amplifiers for driving the transducers 5 using the wireless signals received from the test receiver 2.

As noted above, the loudspeakers 3 emit sound into the listening area 1 to represent one or more channels of a piece of sound program content. The listening area 1 is a location in which the loudspeakers 3 are located and in which a listener is positioned to listen to sound emitted by the loudspeakers 3. For example, the listening area 1 may be a room within a house, commercial, or manufacturing establishment or an outdoor area (e.g., an amphitheater). The listener may be holding the listening device 4 such that the listening device 4 is able to sense similar or identical sounds, including level, pitch, and timbre, perceivable by the listener.

Figure 2:
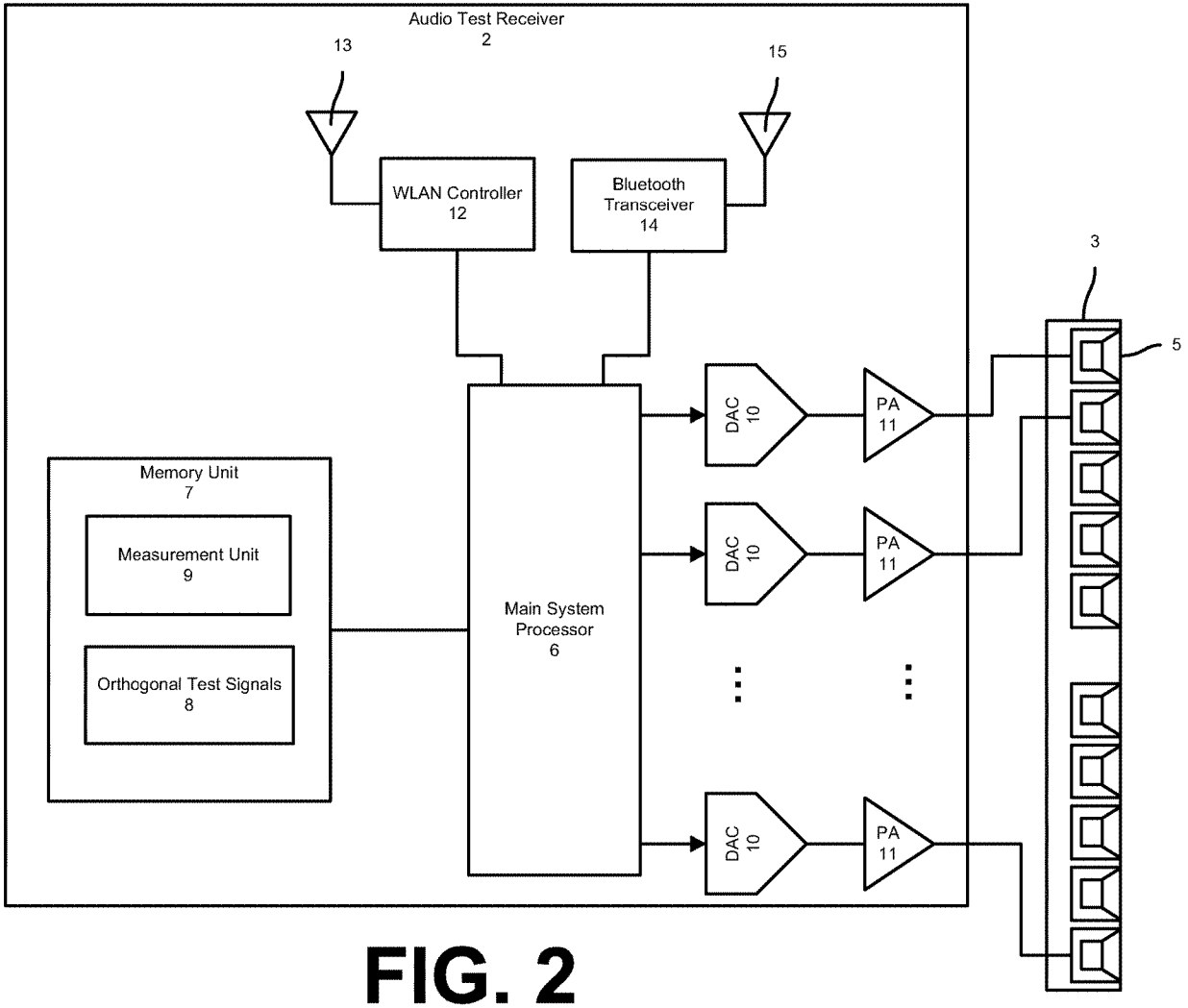
FIG. 2 shows a functional unit block diagram and some constituent hardware components of the test receiver according to one embodiment.

Although shown as separate, in one embodiment the test receiver 2 is integrated within one or more of the loudspeakers 3. FIG. 2 shows a functional unit block diagram and some constituent hardware components of the test receiver 2 according to one embodiment. The components shown in FIG. 2 are representative of elements included in the test receiver 2 and should not be construed as precluding other components. Each element of the test receiver 2 will be described by way of example below.

The test receiver 2 may include a main system processor 6 and memory unit 7. The processor 6 and memory unit 7 are generically used here to refer to any suitable combination of programmable data processing components and data storage that conduct the operations needed to implement the various functions and operations of the test receiver 2. The processor 6 may be a special purpose processor such as an application-specific integrated circuit (ASIC), a general purpose microprocessor, a field-programmable gate array (FPGA), a digital signal controller, or a set of hardware logic structures (e.g., filters, arithmetic logic units, and dedicated state machines) while the memory unit 7 may refer to microelectronic, non-volatile random access memory. An operating system may be stored in the memory unit 7, along with application programs specific to the various functions of the test receiver 2, which are to be run or executed by the processor 6 to perform the various functions of the test receiver 2. For example, the test receiver 2 may include a measurement unit 9, which in conjunction with other hardware elements of the test receiver 2, drive individual transducers 5 in the loudspeakers 3 to emit sound. As will be described in further detail below, the measurement unit 9 may use these emitted sounds to measure and characterize each transducer 5 in one or more loudspeakers 3 to determine overall performance of the transducers 5.

In one embodiment, the test receiver 2 may include a set of orthogonal test signals 8. The orthogonal test signals 8 may be pseudorandom noise sequences, such as maximum length sequences. The pseudorandom noise sequences are signals similar to noise which satisfy one or more of the standard tests for statistical randomness. In one embodiment, the orthogonal test signals 8 may be generated using a linear shift register. Taps of the shift register would be set differently for each transducer 5, thus ensuring that the generated orthogonal test signal 8 for a transducer 5 is highly orthogonal to all other orthogonal test signals 8. The orthogonal test signals 8 may be binary sequences with lengths of $2^{N-1}$, where N is the number of transducers 5 being simultaneously tested. For polarity checks, the orthogonal test signals 8 may be short (e.g., 100 milliseconds in duration), while for more detailed transfer function determinations, longer sequences and averaging are desirable.

Figure 3A:
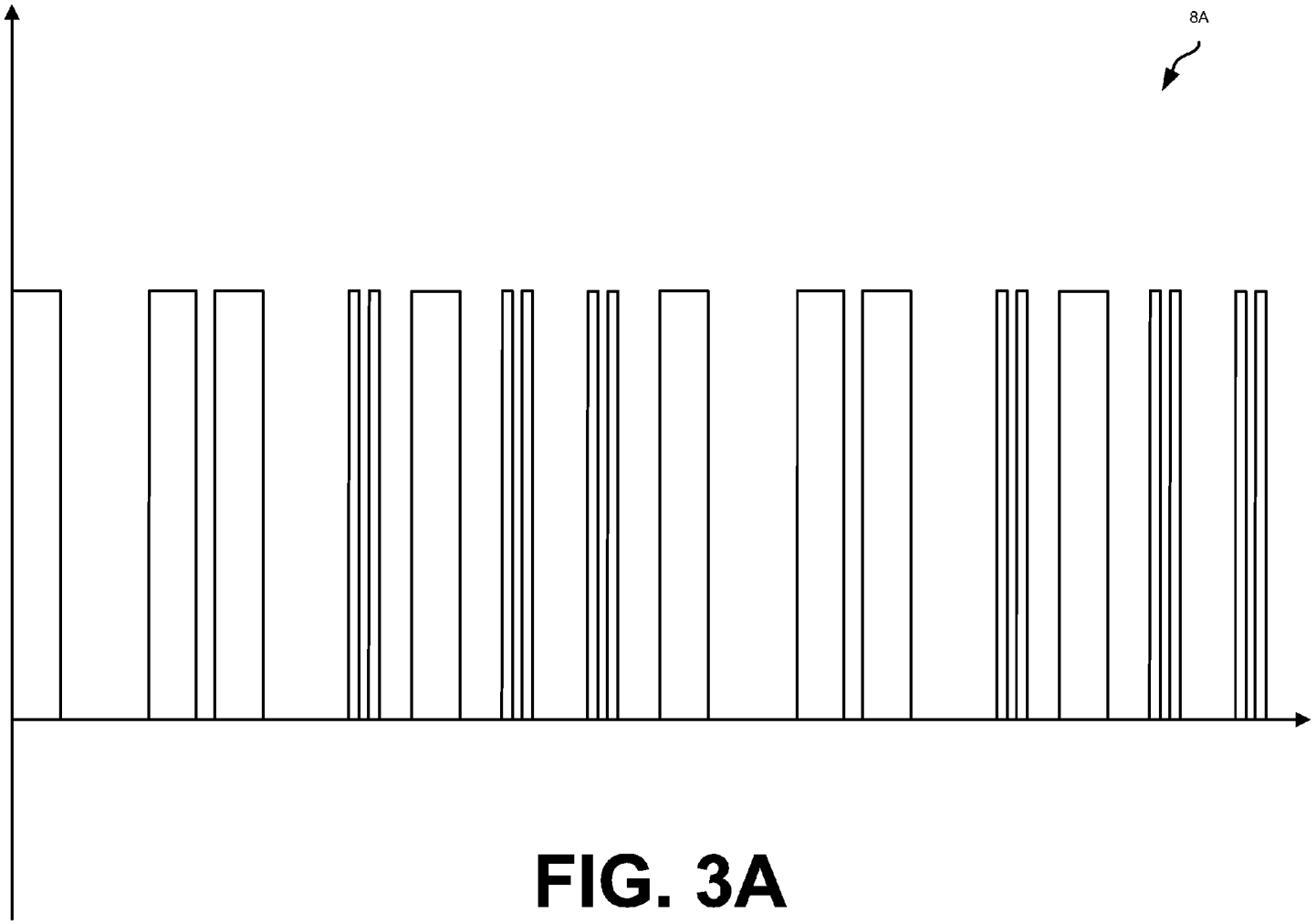
FIGS. 3A and 3B show example orthogonal test signals corresponding to separate transducers according to one embodiment.
Figure 3B:
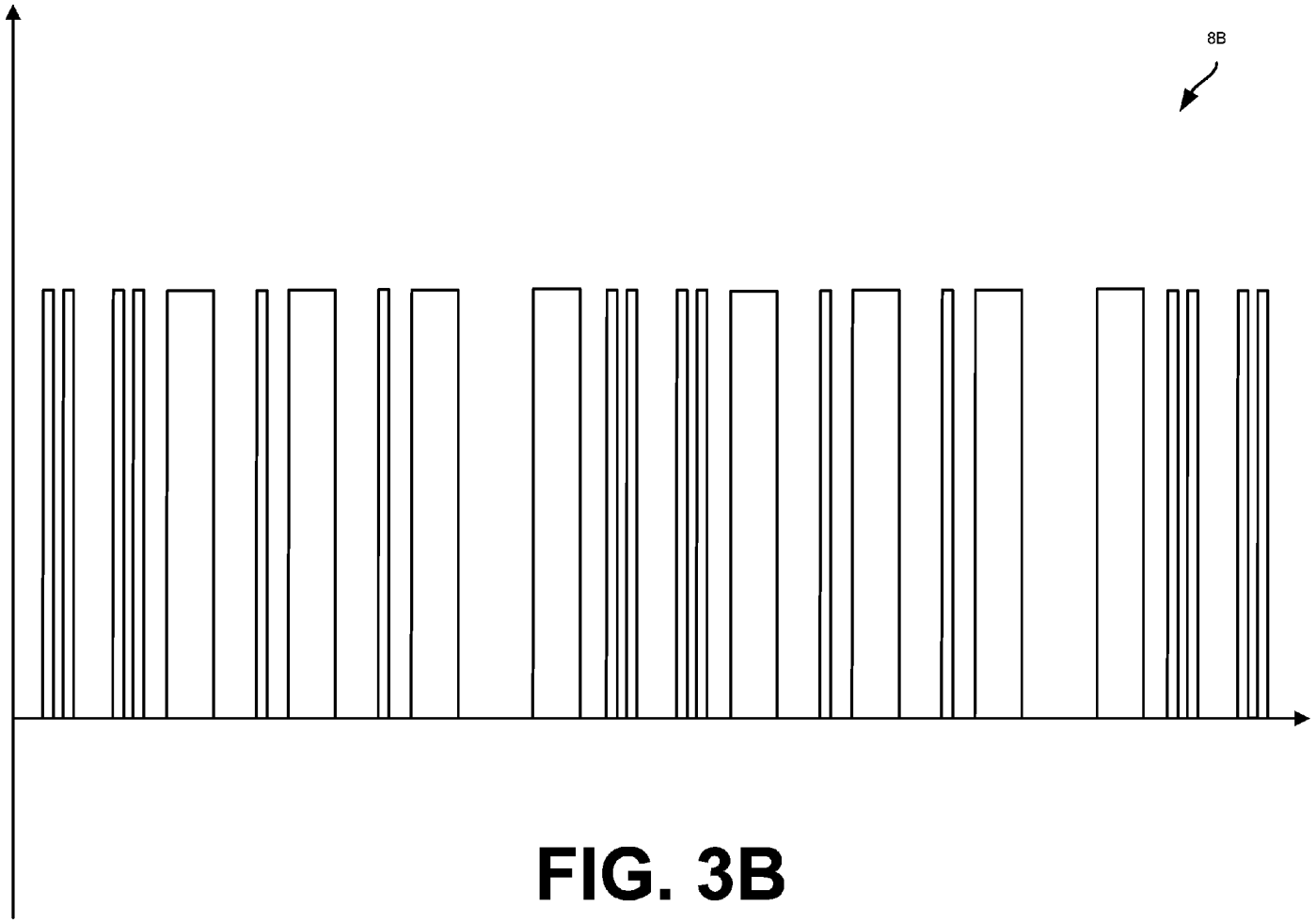

In one embodiment, each of the one or more orthogonal test signals 8 is associated with a single transducer 5 in the loudspeakers 3. For example, a loudspeaker 3 with twelve transducers 5 may have twelve distinct orthogonal test signals 8 associated with the twelve transducers 5 in a one-to-one relationship. FIGS. 3A and 3B show example orthogonal test signals 8A and 8B corresponding to transducers 5A and 5B. The orthogonal test signals 8 may be stored in the memory unit 7 or another storage unit integrated or accessible to the test receiver 2. The orthogonal test signals 8 may be used to measure or characterize each transducer 5 to determine overall performance of the transducers 5 as will be described in further detail below.

In one embodiment, the main system processor 6 retrieves one or more of the orthogonal test signals 8 in response to a request to measure or characterize one or more transducers 5 in one or more loudspeakers 3. The request may be instigated by a remote device (e.g., the listening device 4) or a component within the test receiver 2. For example, the main system processor 6 may begin a procedure for measuring each transducer 5 in a loudspeaker 3 (e.g., a procedure defined by the measurement unit 9) by retrieving one or more of the orthogonal test signals 8 in response to a user selecting a test button on the test receiver 2. In another embodiment, the main system processor 6 may periodically retrieve one or more of the orthogonal test signals 8 to measure each transducer 5 in the loudspeaker 3 (e.g., every minute).

The main system processor 6 may feed the orthogonal test signals 8 to the one or more digital-to-analog converters 10 to produce one or more distinct analog signals. The analog signals produced by the digital-to-analog converters 10 are fed to the power amplifiers 11 to drive a corresponding transducer 5 in the loudspeaker 3. In one embodiment, sounds corresponding to each orthogonal test signal 8 are simultaneously emitted into the listening area 1 by the transducers 5. As will be described in further detail below, the listening device 4 may simultaneously sense the sounds produced by the transducers 5 using one or more microphones. These sensed signals may be used to measure or characterize each transducer 5 in one or more loudspeakers 3.

In one embodiment, the main system processor 6 may process the orthogonal test signals 8 prior to feeding the signals to the digital-to-analog converters 10. For example, the main system processor 6 may equalize one or more of the orthogonal test signals 8 to produce desired spectral characteristics.

In one embodiment, the test receiver 2 may also include a wireless local area network (WLAN) controller 12 that receives and transmits data packets from a nearby wireless router, access point, and/or other device, using antenna 13. The WLAN controller 12 may facilitate communications between the test receiver 2 and the listening device 4 and/or the loudspeakers 3 through an intermediate component (e.g., a router or a hub). In one embodiment, the test receiver 2 may also include a Bluetooth transceiver 14 with an associated antenna 15 for communicating with the listening device 4, the loudspeakers 3, and/or another device.

Figure 4:
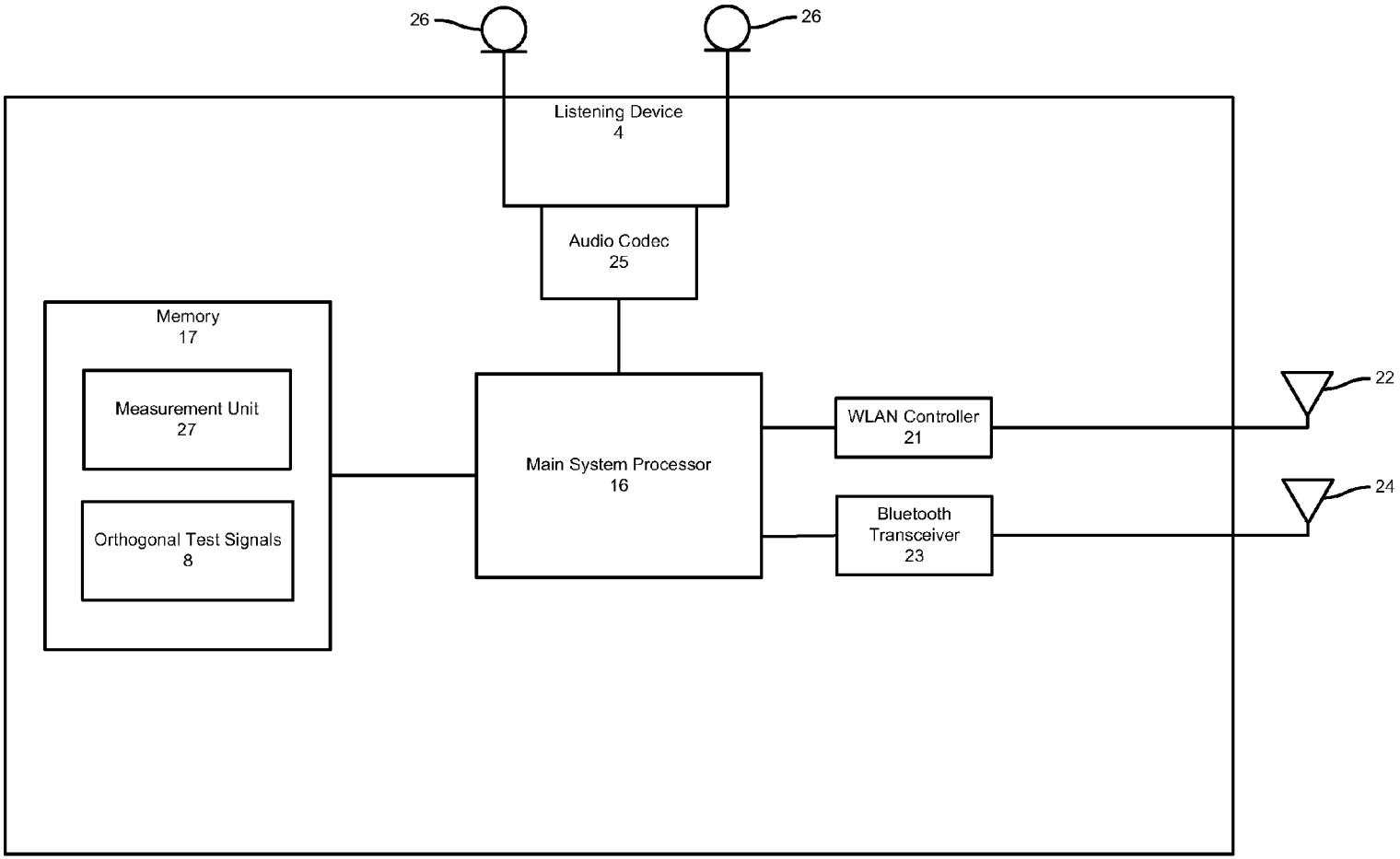
FIG. 4 shows a functional unit block diagram and some constituent hardware components of the listening device according to one embodiment.

FIG. 4 shows a functional unit block diagram and some constituent hardware components of the listening device 4 according to one embodiment. The components shown in FIG. 4 are representative of elements included in the listening device 4 and should not be construed as precluding other components. Each element of the listening device 4 will be described by way of example below.

The listening device 4 may include a main system processor 16 and a memory unit 17. The processor 16 and the memory unit 17 are generically used here to refer to any suitable combination of programmable data processing components and data storage that conduct the operations needed to implement the various functions and operations of the listening device 4. The processor 16 may be an applications processor typically found in a smart phone, while the memory unit 17 may refer to microelectronic, non-volatile random access memory. An operating system may be stored in the memory unit 17, along with application programs specific to the various functions of the listening device 4, which are to be run or executed by the processor 16 to perform the various functions of the listening device 4.

In one embodiment, the listening device 4 may also include a wireless local area network (WLAN) controller 21 that receives and transmits data packets from a nearby wireless router, access point, and/or other device using an antenna 22. The WLAN controller 21 may facilitate communications between the test receiver 2 and the listening device 4 through an intermediate component (e.g., a router or a hub). In one embodiment, the listening device 4 may also include a Bluetooth transceiver 23 with an associated antenna 24 for communicating with the test receiver 2. For example, the listening device 4 and the test receiver 2 may share or synchronize data using one or more of the WLAN controller 21 and the Bluetooth transceiver 23.

In one embodiment, the listening device 4 may include an audio codec 25 for managing digital and analog audio signals. For example, the audio codec 25 may manage input audio signals received from one or more microphones 26 coupled to the codec 25. Management of audio signals received from the microphones 26 may include analog-to-digital conversion and general signal processing. The microphones 26 may be any type of acoustic-to-electric transducer or sensor, including a MicroElectrical-Mechanical System (MEMS) microphone, a piezoelectric microphone, an electret condenser microphone, or a dynamic microphone. The microphones 26 may provide a range of polar patterns, such as cardioid, omnidirectional, and figure-eight. In one embodiment, the polar patterns of the microphones 26 may vary continuously over time. In one embodiment, the microphones 26 are integrated in the listening device 4. In another embodiment, the microphones 26 are separate from the listening device 4 and are coupled to the listening device 4 through a wired or wireless connection (e.g., Bluetooth and IEEE 802.11x).

In one embodiment, the listening device 4 may include the set of orthogonal test signals 8. As noted above in relation to the test receiver 2, each of the one or more orthogonal test signals 8 is associated with a single transducer 5 in the loudspeaker 3. For example, a loudspeaker 3 with twelve transducers 5 may have a one-to-one relationship with twelve distinct orthogonal test signals 8. The orthogonal test signals 8 may be stored in the memory unit 17 or another storage unit integrated or accessible to the listening device 4. The orthogonal test signals 8 may be used to measure or characterize one or more transducers 5 in the loudspeaker as will be described in further detail below.

In one embodiment, the orthogonal test signals 8 may be identical to the orthogonal test signals 8 stored in the test receiver 2. In this embodiment, the orthogonal test signals 8 are shared or synchronized between the listening device 4 and the test receiver 2 using one or more of the WLAN controllers 12 and 21 and the Bluetooth transceivers 14 and 23.

In one embodiment, the listening device 4 includes a measurement unit 27 for measuring and characterizing each transducer 5 in one or more loudspeakers 3. The measurement unit 27 of the listening device 4 may work in conjunction with the measurement unit 9 of the test receiver 2 to determine the orientation of the loudspeaker array 3 relative to the listening device 4.

Although described as a computing device, in one embodiment the listening device 4 is a microphone or set of microphones coupled to the test receiver 2 through a wired or wireless connection. In this embodiment, all processing (e.g., measurement and characterization of each transducer 5 of one or more loudspeakers 3) is performed by the test receiver 2.

Figure 5:
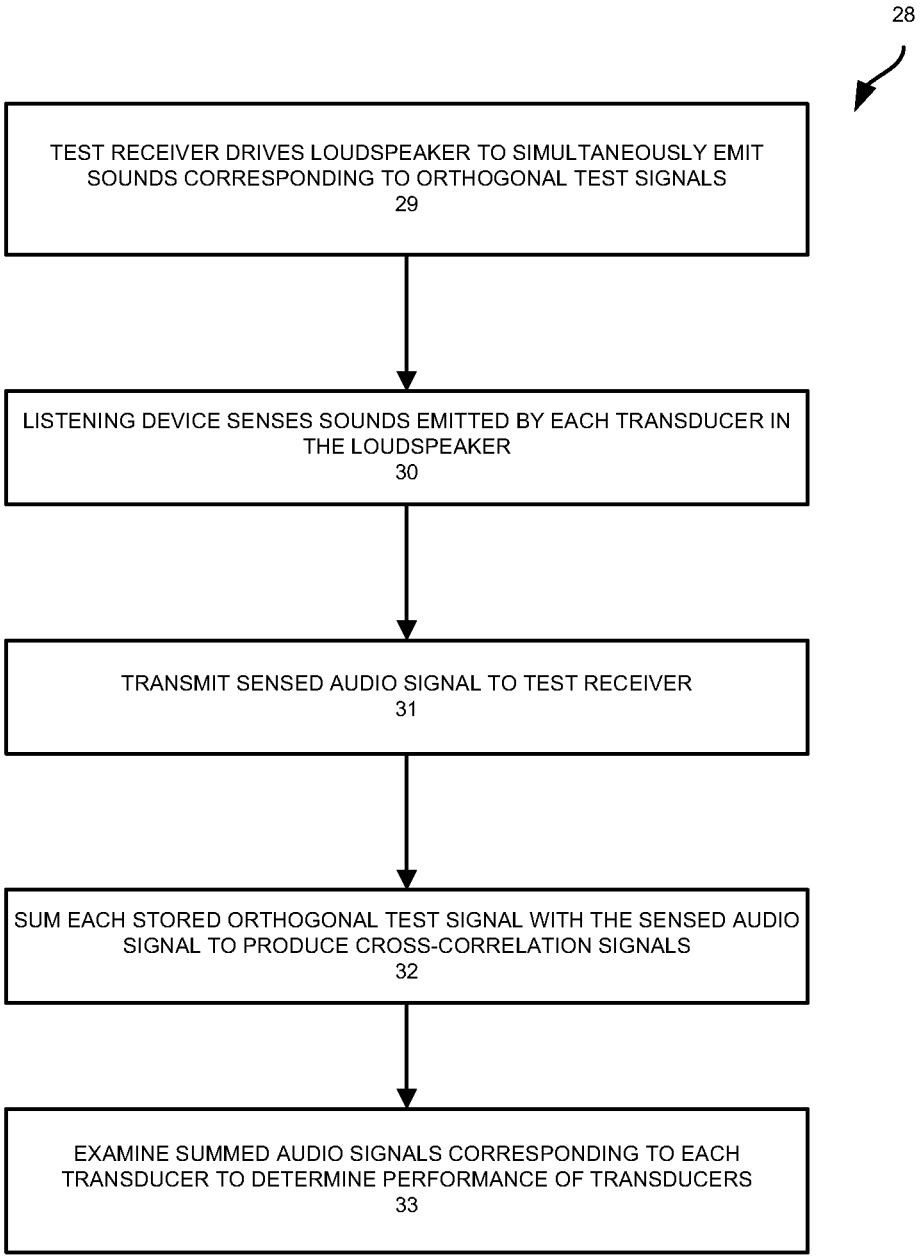
FIG. 5 shows a method for measuring and characterizing each transducer in one or more loudspeakers to determine the performance of each transducer according to one embodiment.

FIG. 5 shows a method 28 for measuring and characterizing each transducer 5 in one or more loudspeakers 3 to determine the performance of each transducer 5 according to one embodiment. The method 28 may be performed by one or more components of both the test receiver 2 and the listening device 4. In one embodiment, one or more of the operations of the method 28 are performed by the measurement units 9 and 27. Although described in relation to a single loudspeaker 3 with a plurality of transducers 5, the method 28 may be similarly applied to a set of loudspeakers 3 with a varied amount of transducers 5.

In one embodiment, the method 28 begins at operation 29 with the test receiver 2 driving the loudspeaker 3 to simultaneously emit the orthogonal test signals 8. As noted above, the test receiver 2 may drive each transducer 5 in the loudspeaker 3 to emit separate orthogonal test signals 8. As noted above, FIGS. 3A and 3B show example orthogonal test signals 8A and 8B corresponding to transducers 5A and 5B in the loudspeaker 3. The relationship between each transducer 5 and the orthogonal test signals 8 may be stored along with the orthogonal test signals 8 in the test receiver 2 and/or the listening device 4. For example, the following table may be stored in the test receiver 2 and/or the listening device 4 demonstrating the relationship between each of twelve transducers 5 in the loudspeaker 3 and corresponding orthogonal test signals 8:

TABLE 1

| Transducer Identifier | Orthogonal Test Signal Identifier |
|---|---|
| 5A | 8A |
| 5B | 8B |
| 5C | 8C |
| 5D | 8D |
| 5E | 8E |
| 5F | 8F |
| 5G | 8G |
| 5H | 8H |
| 5I | 8I |
| 5J | 8J |
| 5K | 8K |
| 5L | 8L |

In one embodiment, the orthogonal test signals 8 are ultrasonic signals that are above the normal limit perceivable by humans. For example, the orthogonal test signals 8 may be above 20 kHz. In this embodiment, the test receiver 2 may drive the transducers 5 to emit sounds corresponding to the orthogonal test signals 8 while simultaneously driving the transducers 5 to emit sounds corresponding to a piece of sound program content (e.g., a musical composition or an audio track for a movie). Using this methodology, the orthogonal test signals 8 may be used to measure or characterize the performance of each transducer 5 while the loudspeaker 3 is normally operating. Accordingly, measurement of each transducer 5 may be continually and variably determined without affecting a listener's audio experience. In one embodiment, the orthogonal test signals 8 are beamformed audio signals, which are used to generate corresponding beam/polar patterns.

At operation 30, the listening device 4 senses sounds produced by the loudspeaker 3. Since the orthogonal test signals 8 are simultaneously output by separate transducers 5 in the loudspeaker 3, the listening device 4 generates a single sensed audio signal, which includes sounds corresponding to each of the simultaneously played orthogonal test signals 8. For example, the listening device 4 may produce a five millisecond audio signal that includes each of the orthogonal test signals 8. The listening device 8 may sense sounds produced by the loudspeaker array 3 using one or more of the microphones 26 in conjunction with the audio codec 25.

Figure 6:
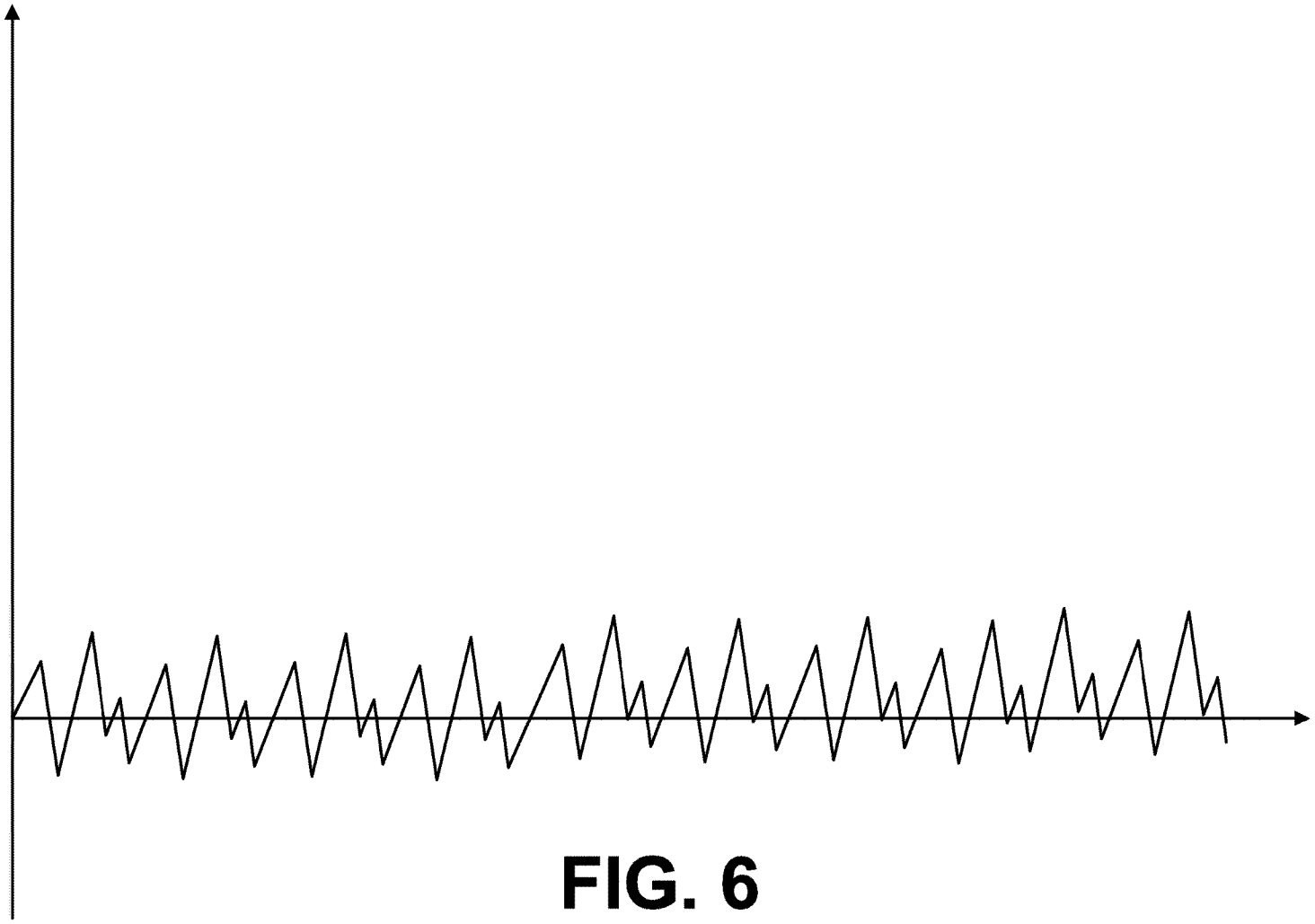
FIG. 6 shows an example of a sensed audio signal generated by the listening device according to one embodiment.

FIG. 6 shows an example of the sensed audio signal according to one embodiment. The sensed audio signal of FIG. 6 is a cross-correlation of the orthogonal test signals 8A-8L, including the orthogonal test signals 8A and 8B shown in FIGS. 3A and 3B and potentially noise observed in the listening area 1.

In one embodiment, the listening device 4 is continually recording sounds in the listening area 1. In another embodiment, the listening device 4 begins to record sounds upon being prompted by the test receiver 2. For example, the test receiver 2 may transmit a record command to the listening device 4 using the WLAN controllers 12 and 21 and/or the Bluetooth transceivers 14 and 23. The record command may be intercepted by the measurement unit 27, which begins recording sounds in the listening area 1.

At operation 31, the listening device 4 transmits the sensed audio signal to the test receiver 2 for processing and measurement. The transmission of the sensed audio signal may be performed using the WLAN controllers 12 and 21 and/or the Bluetooth transceivers 14 and 23. In one embodiment, the listening device 4 performs measurement without assistance from the test receiver 2. In this embodiment, the sensed audio signal is not transmitted to the test receiver 2 at operation 31. Instead, the measurement of the transducers 5, as will be described below, may be performed by the listening device 4 and the measurement results are thereafter transmitted to the test receiver 2 using the WLAN controllers 12 and 21 and/or the Bluetooth transceivers 14 and 23.

Figure 7:
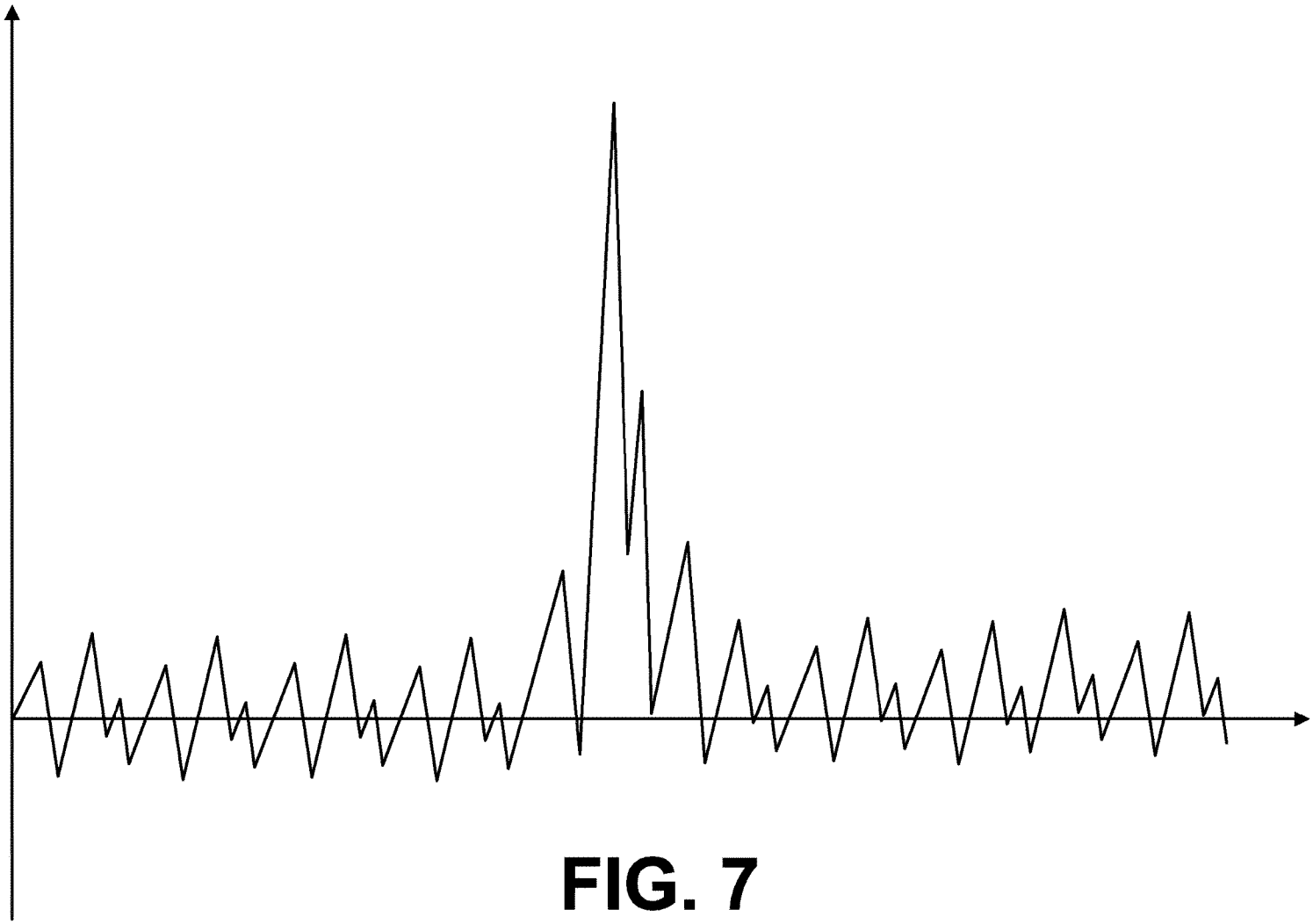
FIG. 7 shows an example cross-correlation signal with a peak according to one embodiment.

At operation 32, the sensed audio signal is individually and separately summed with each stored orthogonal test signal 8 to produce a set of cross-correlation signals. Since the summation is performed for each orthogonal test signal 8, the number of cross-correlation signals will be equal to the number of orthogonal test signals 8. Each of the cross-correlation signals corresponds to the same transducer 5 as its associated orthogonal test signal 8 (for example as shown in Table 1). FIG. 7 shows an example cross-correlation signal corresponding to orthogonal test signal 8A. The cross-correlation signal includes a peak associated with the performance of the associated transducer 5A.

At operation 33, each cross-correlation signal is examined to determine the performance of an associated transducer 5 relative to the listening device 4. In one embodiment, a positive peak may be detected in one or more of the cross-correlation signals. A detected positive peak indicates that corresponding transducers 5 are in-phase and are emitting sound. In response to a detected positive peak, further tests may be performed on the detected peak to determine the operating performance of a corresponding transducer 5. For example, a positive peak in a cross-correlation signal may be compared against a corresponding parameter or tolerance value. For instance, the peak for the cross-correlation signal shown in FIG. 7 may be compared against the range of 10-15 dB to determine the performance of transducer 5A. In this example, if the peak is within the range of 10-15 dB, the transducer 5A is determined to be operating properly. In one embodiment, each transducer 5 or type of transducer 5 (e.g., tweeter, mid-range driver, etc.) may be associated with a corresponding range or parameter value. In another example, in response to a detected positive peak, operation 33 compares the cross-correlation signal with the corresponding orthogonal signal to determine a transfer function for the transducer 5. This transfer function may be used to determine the operating performance of the transducer 5 or be used to perform further fine-grained tests to characterize the performance of the transducer 5.

Figure 8:
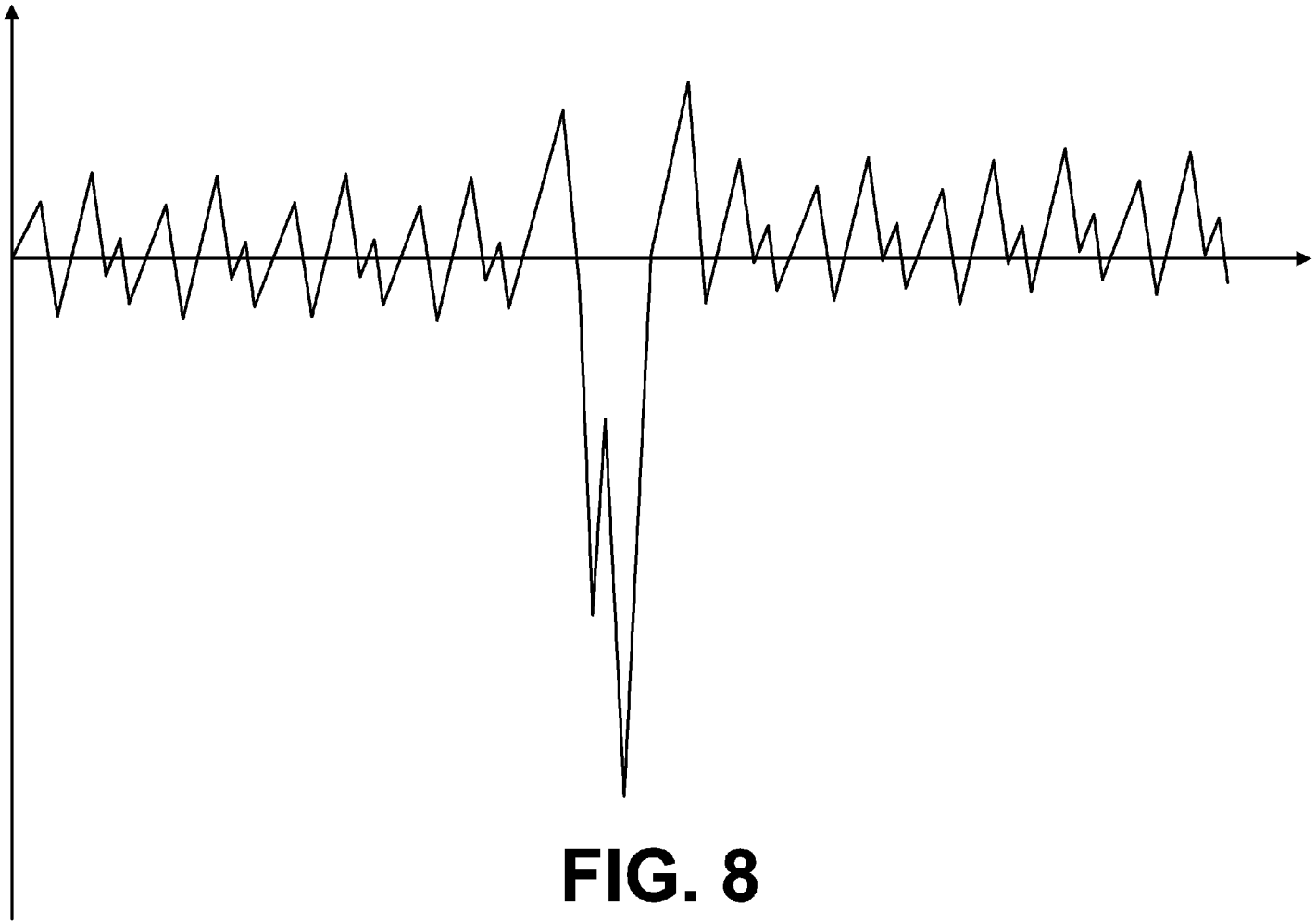
FIG. 8 shows an example cross-correlation signal with a trough according to one embodiment.

In one embodiment, operation 33 may detect a trough (i.e., a negative peak) in one or more cross-correlation signals instead of a pronounced peak (i.e., a positive peak) as shown in FIG. 8. In this embodiment, operation 33 determines that the corresponding transducer's 5 polarity is reversed/out-of-phase.

In another embodiment, operation 33 may detect noise on the order of $\sqrt{N}$ in one or more cross-correlation signals instead of a peak or a trough. In this embodiment, operation 33 determines that the corresponding transducer 5 is disconnected or dead.

In a factory scenario (e.g., the listening area 1 is a factory or test facility), the method 28 allows for measurement and characterization of a multi-transducer 5 loudspeaker system in a greatly reduced period of time in comparison to other test systems. For example, the method 28 allows for the simultaneous testing of multiple transducers 5 through the use of the orthogonal test signals 8. The method 28 immediately reveals if any transducer 5 is disconnected, has inverted polarity, or otherwise performing poorly. Upon detection of an error, the corresponding transducers 5 may be replaced or repaired before other factory testing is performed. Finding performance errors quickly saves valuable factory time and resources compared to sequential transducer 5 testing.

In a home entertainment scenario, this method 28 may be used to calibrate a loudspeaker 3. By using orthogonal test signals 8, measurement and calibration of the loudspeaker 3 is more impervious to extraneous sounds. For example, a user/listener may calibrate a loudspeaker 3 while carrying on a conversation or playing an audio track without affecting the calibration process.

As explained above, an embodiment of the invention may be an article of manufacture in which a machine-readable medium (such as microelectronic memory) has stored thereon instructions which program one or more data processing components (generically referred to here as a "processor") to perform the operations described above. In other embodiments, some of these operations might be performed by specific hardware components that contain hardwired logic (e.g., dedicated digital filter blocks and state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A method for measuring a performance of a plurality of transducers, comprising:

driving each transducer of the plurality of transducers simultaneously using separate orthogonal test signals;

sensing, by a listening device, sound produced by each transducer to produce a sensed audio signal;

retrieving the orthogonal test signals used to drive each transducer;

summing each orthogonal test signal with the sensed audio signal, to generate a cross-correlation signal for each transducer; and determining the performance of each transducer of the plurality of transducers based on the generated cross-correlation signal for the transducer.

2. The method of claim 1, further comprising:

detecting a positive peak in one of the cross-correlation signals indicating the corresponding transducer is in-phase and emitting sound; and comparing the detected peak in the cross-correlation signal with a set of parameters to determine the operating performance of the corresponding transducer.

3. The method of claim 2, wherein the set of parameters is a range.

4. The method of claim 1, further comprising:

detecting a trough in one of the cross-correlation signals; and determining, in response to the detected trough, the transducer corresponding to the cross-correlation signal with the detected trough has a reversed polarity.

5. The method of claim 1, further comprising:

detecting noise on the order of $\sqrt{N}$ in one of the cross-correlation signals, wherein N is a number of transducers in the plurality of transducers; and determining, in response to the detected noise, the transducer corresponding to the cross-correlation signal with the detected noise is disconnected or dead.

6. The method of claim 1, further comprising:

detecting a positive peak in one of the cross-correlation signals indicating the transducer is in-phase and emitting sound; and performing, in response to detection of the positive peak, additional tests on the cross-correlation signal with the detected positive peak to further determine the operating performance of the transducer corresponding to the cross-correlation signal with the detected positive peak.

7. The method of claim 6, wherein the additional tests include comparing the cross-correlation signal with the detected positive peak against a corresponding orthogonal test signal to determine a transfer function for the transducer.

8. The method of claim 1, wherein the transducers are integrated within a single speaker array.

9. The method of claim 1, wherein the transducers are integrated within multiple speaker units.

10. The method of claim 1, wherein the orthogonal test signals are beamformed audio signals.

11. A test receiver for measuring the performance of a plurality of transducers, comprising:

a microphone to sense sounds produced by orthogonal test signals simultaneously played through the plurality of transducers; and a measurement unit to (i) retrieve the orthogonal test signals used to drive each transducer, (ii) sum each orthogonal test signal with the sensed audio signal to generate a cross-correlation signal for each transducer, and (iii) determine the performance of each transducer of the plurality of transducers based on the generated cross-correlation signal for the transducer.

12. The test receiver of claim 11, further comprising:

a memory unit to store the orthogonal test signals and each orthogonal test signal's association with one of the transducers.

13. The test receiver of claim 12, wherein the association indicates which of the orthogonal test signals is played through each transducer.

14. The test receiver of claim 11, wherein the measurement unit is to further detect a positive peak in one of the cross-correlation signals indicating the corresponding transducer is in-phase and emitting sound and compare the detected peak in the cross-correlation signal with a set of parameters to determine the operating performance of the corresponding transducer.

15. The test receiver of claim 14, wherein the set of parameters is a range.

16. The test receiver of claim 11, wherein the measurement unit is to further detect a trough in one of the cross-correlation signals and determine, in response to the detected trough, the transducer corresponding to the cross-correlation signal with the detected trough has a reversed polarity.

17. The test receiver of claim 11, wherein the measurement unit is to further detect noise on the order of $\sqrt{N}$ in one of the cross-correlation signals, wherein N is a number of transducers in the plurality of transducers; and determine, in response to the detected noise, the transducer corresponding to the cross-correlation signal with the detected noise is disconnected or dead.

18. The test receiver of claim 11, wherein the measurement unit is to further detect a positive peak in one of the cross-correlation signals indicating the corresponding transducer is in-phase and emitting sound and perform, in response to detection of the positive peak, additional tests on the cross-correlation signal with the detected positive peak to further determine the operating performance of the transducer corresponding to the cross-correlation signal with the detected positive peak.

19. The test receiver of claim 18, wherein the additional tests include comparing the cross-correlation signal with the detected positive peak against a corresponding orthogonal test signal to determine a transfer function for the transducer.

20. The test receiver of claim 11, further comprising:

a plurality of power amplifiers for driving each of the plurality of transducers to play the orthogonal test signals simultaneously.

21. An article of manufacture, comprising:

a non-transitory machine-readable storage medium that stores instructions which, when executed by a processor in a computer, signal that each transducer of a plurality of transducers be driven simultaneously using separate orthogonal test signals; and retrieve the orthogonal test signals used to drive each transducer;

generate a cross-correlation signal for each transducer, based on i) the orthogonal test signal used to drive the transducer and ii) the sensed audio signal; and determine the performance of each transducer using the generated cross-correlation signal for the transducer.

22. The article of manufacture of claim 21, wherein the storage medium includes further instructions which, when executed by the processor, detect a positive peak in one of the cross-correlation signals indicating the corresponding transducer is in-phase and emitting sound; and compare the detected peak in the cross-correlation signal with a set of parameters to determine the operating performance of the corresponding transducer.

23. The article of manufacture of claim 22, wherein the set of parameters is a range.

24. The article of manufacture of claim 21, wherein the storage medium includes further instructions which, when executed by the processor, detect a trough in one of the cross-correlation signals; and determine, in response to the detected trough, the transducer corresponding to the cross-correlation signal with the detected trough has a reversed polarity.

25. The article of manufacture of claim 21, wherein the storage medium includes further instructions to which, when executed by the processor, detect noise on the order of $\sqrt{N}$ in one of the cross-correlation signals, wherein N is a number of transducers in the plurality of transducers; and determine, in response to the detected noise, the transducer corresponding to the cross-correlation signal with the detected noise is disconnected or dead.

26. The article of manufacture of claim 21, wherein the storage medium includes further instructions which, when executed by the processor, detect a positive peak in one of the cross-correlation signals indicating the transducer is in-phase and emitting sound; and perform, in response to detection of the positive peak, additional tests on the cross-correlation signal with the detected positive peak to further determine the operating performance of the transducer corresponding to the cross-correlation signal with the detected positive peak.

27. The article of manufacture of claim 21, wherein the additional tests include comparing the cross-correlation signal with the detected positive peak against a corresponding orthogonal test signal to determine a transfer function for the transducer.

28. The article of manufacture of claim 21, wherein the transducers are integrated within a single speaker array.

29. The article of manufacture of claim 21, wherein the transducers are integrated within multiple speaker units.

30. The article of manufacture of claim 21, wherein the orthogonal test signals are beamformed audio signals.

* * * * *